US007598211B2

(12) United States Patent
Karol et al.

(10) Patent No.: US 7,598,211 B2
(45) Date of Patent: Oct. 6, 2009

(54) SYNERGISTIC ORGANOBORATE COMPOSITIONS AND LUBRICATING COMPOSITIONS CONTAINING SAME

(75) Inventors: Thomas J. Karol, Holualoa-Kona, HI (US); Steven G. Donnelly, Bethel, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 0 days.

(21) Appl. No.: 10/678,408

(22) Filed: Oct. 2, 2003

(65) Prior Publication Data

US 2004/0138073 A1 Jul. 15, 2004

Related U.S. Application Data

(60) Provisional application No. 60/416,061, filed on Oct. 4, 2002.

(51) Int. Cl.
*C10M 141/12* (2006.01)

(52) U.S. Cl. ..... 508/194; 508/195; 508/196; 508/274; 508/364; 508/371; 508/376; 508/433; 508/444

(58) Field of Classification Search ..... 508/194, 508/274, 436, 195, 196
See application file for complete search history.

(56) References Cited

U.S. PATENT DOCUMENTS

| | | | | | |
|---|---|---|---|---|---|
| 3,567,638 | A * | 3/1971 | Braid | ..... | 508/425 |
| 4,389,322 | A | 6/1983 | Horodysky | | |
| 4,478,732 | A * | 10/1984 | Horodysky et al. | ..... | 508/190 |
| 4,594,171 | A * | 6/1986 | Horodysky et al. | ..... | 508/194 |
| 4,761,482 | A * | 8/1988 | Karol | ..... | 548/142 |
| 4,889,647 | A * | 12/1989 | Rowan et al. | ..... | 508/367 |
| 5,055,584 | A * | 10/1991 | Karol | ..... | 508/274 |
| 5,068,045 | A * | 11/1991 | Doner et al. | ..... | 508/194 |
| 5,138,065 | A * | 8/1992 | Karol | ..... | 508/274 |
| 5,354,484 | A * | 10/1994 | Schwind et al. | ..... | 508/192 |
| 5,543,081 | A * | 8/1996 | Ishida et al. | ..... | 508/194 |
| 5,569,405 | A * | 10/1996 | Nakazato et al. | ..... | 508/192 |
| 5,629,272 | A * | 5/1997 | Nakazato et al. | ..... | 508/185 |
| 5,641,731 | A | 6/1997 | Baumgart et al. | | |
| 5,925,600 | A * | 7/1999 | Atherton | ..... | 508/364 |
| 6,187,723 | B1 * | 2/2001 | Holt et al. | ..... | 508/364 |
| 6,627,583 | B2 | 9/2003 | Inoue et al. | ..... | 508/186 |
| 6,806,241 | B2 * | 10/2004 | Karol et al. | ..... | 508/273 |
| 2003/0119682 | A1 | 6/2003 | Saini et al. | | |

FOREIGN PATENT DOCUMENTS

| | | |
|---|---|---|
| CA | 2014775 | * 10/1990 |
| CA | 2184969 | * 7/2007 |

* cited by examiner

*Primary Examiner*—Ellen M McAvoy
(74) *Attorney, Agent, or Firm*—Norris, McLaughlin & Marcus, P.A.

(57) ABSTRACT

An additive for imparting antiwear properties to a lubricant composition is based on a combination of (1) an organo borate ester composition and (2) one or more sulfur- or phosphorus-containing compounds or a non-sulfur molybdenum compound. The sulfur- or phosphorus-containing compounds are dithiocarbamate, bisdithiocarbamate, 1,3,4-diathiazole, phosphorodithioate, phosphorodithioate esters, and the molybdenum compound is prepared by reacting (a) about 1.0 mole of fatty oil having 12 or more carbon atoms, (b) about 1.0 to 2.5 moles diethanolamine and (c) a molybdenum source.

12 Claims, 3 Drawing Sheets

Evaluation of Friction Reducers by ASTM D5707 (SRV)

Evaluation of Friction Reducers by ASTM D5707 (SRV)

ASTM D5707 SRV : 200 N; 50Hz ;80C; 1.00 mm stroke; 50 minutes; ball on disk

Evaluation of Friction Reducers by ATSM D5707-SRV

ASTM D5707-SRV : 200 N ; 50 Hz ; 80C ; 1.0 mm stroke ; 120 minutes ;ball on disk

SYNERGISTIC ORGANOBORATE COMPOSITIONS AND LUBRICATING COMPOSITIONS CONTAINING SAME

This is a non-provisional of U.S. Ser. No. 60/416,061, filed Oct. 4, 2002.

BACKGROUND OF THE INVENTION

The invention concerns lubricating compositions which impart antiwear and anti-scuffing properties with reduced levels of phosphorus. Another aspect of this invention is the lowering of sulfur and/or phosphorus, or the complete elimination of phosphorus, in lubricating compositions intended for lubricants where high amounts of sulfur and/or phosphorous are not desirable.

The trend in recent years in lubricant technology, and specifically in passenger car motor oils, is to reduce the levels of phosphorus in the oil that comes from the antiwear additive called zinc dialkyldithiophosphate (ZDDP). The current levels of phosphorus in motor oils is set at 0.10% P and a movement is underway to reduce this to either 0.08% or 0.05% P, with the eventual elimination of phosphorus altogether. The problem is maintaining adequate antiwear protection in the oil at a reasonable cost. The concern with P in motor oil is its poisoning effect on catalytic converters. Likewise, there is a movement toward reducing the overall presence of sulfur in motor oils, both because of environmental concerns, as well as because of the effect of sulfur as a corrosive. As sulfur based compounds are now commonly used as antiwear additives, there is a strong desire to reduce the amount of these compounds needed to achieve effective antiwear protection.

It is known that certain borate ester composition possess antifriction properties as well as other desirable lubricating characteristics as disclosed in U.S. Pat. No. 4,389,322, which is hereby incorporated by reference.

U.S. Pat. No. 5,641,731 and U.S. patent application Publication No. 2003/0119682 teach a 7-component lubricant additive, comprising the following components: an oil soluble molybdenum additive, zinc dithiophosphate, non-aqueous PTFE, a poly-alpha-olefin, a diester, a viscosity index improver and a borate ester composition. The non-sulfur Molyvan® 855 organo molybdenum amide complex is tested as a specific Mo component, and Mo dithiocarbamate is also indicated as a possible additive. The reference relates to a comprehensive formulation seeking to improve numerous properties simultaneously, of which antiwear protection is only one. While the patentee reports improvements in antiwear properties, the presence of zinc dithiophosphate is at very high levels. Thus, the dispersant inhibitor containing compound which includes zinc dithiophosphate has a phosphorus component of roughly 1 mass %. As the reference teaches adding the dispersant inhibitor at levels of about 11 vol % (about 12.3 mass %), the P level in the lubricant would be about 0.1 mass %. Thus, this high P level renders this formulation unsuitable for the new GF-4 requirements.

Surprisingly, it has been discovered that organo borate ester composition produce a synergistic antiwear effect in combination with certain organic sulfur, organic phosphorus and non-sulfur molybdenum compounds, with the result that lower amounts of these compounds may be used while retaining or increasing their effectiveness in the performance level of the lubricant. Excellent improvements in the performance of known antiwear additives can be achieved by using small amounts of a borate ester composition having low concentrations of boron in combination with these additives. The additives which show a synergistic effect in combination with borate ester composition include dithiophosphates such as zinc dialkyl dithiophosphate (ZDDP), dithiocarbamates such as molybdenum dithiocarbamates and ashless dithiocarbamate, thiadiazoles and non-sulfur molybdenum amide complexes such as Molyvan® 855 lubricant additive. It is surprising that tenacious films are being formed on metal surfaces when the combined additive is used in a lubricant, and that these films enhance the performance of all the different classes of antiwear compounds listed above.

With respect to dithiophosphate compounds, this is advantageous in that the amount of phosphorus may be greatly lowered, to well below 0.05 mass %, while retaining the necessary performance. Further, it is also advantagous to be able to lower the total sulfur used in antiwear additives, as new GF-4 specifications will limit the allowable sulfur. The two-component system combinations discovered by the applicants provide excellent performance, with a lower amount of the sulfur compounds (and lower phosphorus in the case of dithiophosphates), thereby permitting a lower sulfur (and/or phosphorus) total in the overall lubricant. As for non-sulfur molybdenum compounds such as the molybdenum amide complex Molyvan® 855 additive, cost of antiwear protection can be reduced by using lower amounts of the additive in combination with the organo borate ester composition.

SUMMARY OF THE INVENTION

According to the invention, there are provided synergistic antiwear compositions comprising:

(1) an organo borate ester composition; and (2) an organic sulfur or phosporous compound, a non-sulfur-molybdenum compounds, or mixtures thereof, selected from the group consisting of:

(i) 1,3,4-thiadiazole compounds of the formula (I):

(I)

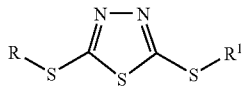

wherein R and $R^1$ are independently selected from hydrogen and $C_{8-12}$ thioalkyl or hydrogen, $C_{1-22}$-alkyl groups, terpene residue and maleic acid residue of the formula:

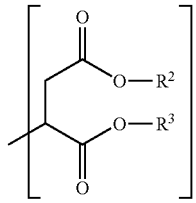

10 and $R^2$ and $R^3$ represent $C_{1-22}$-alkyl and $C_{5-7}$-cycloalkyl groups, R or $R^1$ and either $R^2$ or $R^3$ may be hydrogen;

(ii) bisdithiocarbamate compounds of the formula (II):

(II)

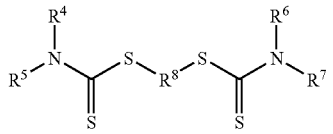

wherein $R^4$, $R^5$, $R^6$, and $R^7$ are aliphatic hydrocarbyl groups having 1 to 13 carbon atoms and $R^8$ is an alkylene group having 1 to 8 carbon atoms;

(iii) dithiocarbamates of the formula (III):

(III)

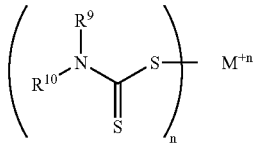

wherein $R^9$ and $R^{10}$ represent alkyl groups having 1 to 8 carbon atoms, M represents metals of the periodic groups IIA, IIIA, VA, VIA, IB, IIB, VIB, VIII and a salt moiety formed from an amine of the formula:

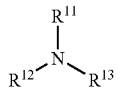

$R^{11}$, $R^{12}$ and $R^{13}$ being independently selected from hydrogen and aliphatic groups having 1 to 18 carbon atoms and n is the valence of M; or the formula (IV):

(IV)

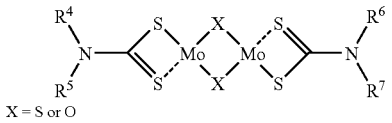

where $R^4$, $R^5$, $R^6$, and $R^7$ are aliphatic hydrocarbyl groups having 1 to 13 carbon atoms;

(iv) phosphorodithioates of the formula (V):

(V)

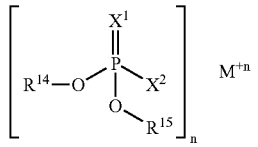

wherein $X^1$ and $X^2$ are independently selected from S and O, $R^{14}$ and $R^{15}$ represent hydrogen and alkyl groups having 1 to 22 carbon atoms, M represents metals of the periodic groups IIA, IIIA, VA, VIA, IB, IIB, VIB, VIII and a salt moiety formed from an amine of the formula:

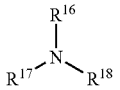

$R^{16}$, $R^{17}$ and $R^{18}$ being independently selected from hydrogen and aliphatic groups having 1 to 18 carbon atoms and n is the valence of M; and (v) phosphorodithioate esters of the formula (VI):

(VI)

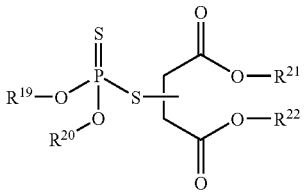

wherein $R^{19}$, $R^{20}$, $R^{21}$, and $R^{22}$ may be the same or different and are selected from alkyl groups having 1 to 8 carbon atoms;

(vi) a non-sulfur molybdenum additive prepared by sequentially reacting fatty oil, diethanolamine and a molybdenum source by the condensation method described in U.S. Pat. No. 4,889,647, which is incorporated herein by reference, which is believed to comprise the following components:

(VII)

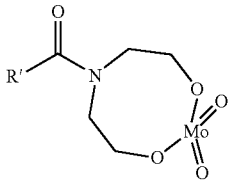

and/or

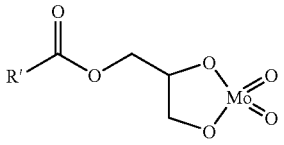

wherein R' is a fatty oil residue. In one embodiment, the non-sulfur molybdenum additive can be prepared by reacting (a) about 1.0 mole of fatty oil having 12 or more carbon atoms, (b) about 1.0 to 2.5 moles diethanolamine and (c) a molybdenum source.

Another embodiment of the invention relates to lubricating compositions having improved lubricating properties and comprising a major portion of an oil of lubricating viscosity and about 0.1 to about 10.0 percent by mass, based on the total mass of the lubricating composition, of a composition comprising (1) an organo borate ester composition and (2) a organic compound of the formula I, II, III, IV, V, VI, VII, or mixtures thereof. One embodiment of this lubrication composition comprises about 0.5 to about 3.0 percent by mass, based on the total mass of the lubrication composition, of a composition comprising (1) an organo borate ester composition and (2) a organic compound of the formula I, II, III, IV, V, VI, VII, or mixtures thereof.

DETAILED DESCRIPTION OF THE INVENTION

Figure 1:
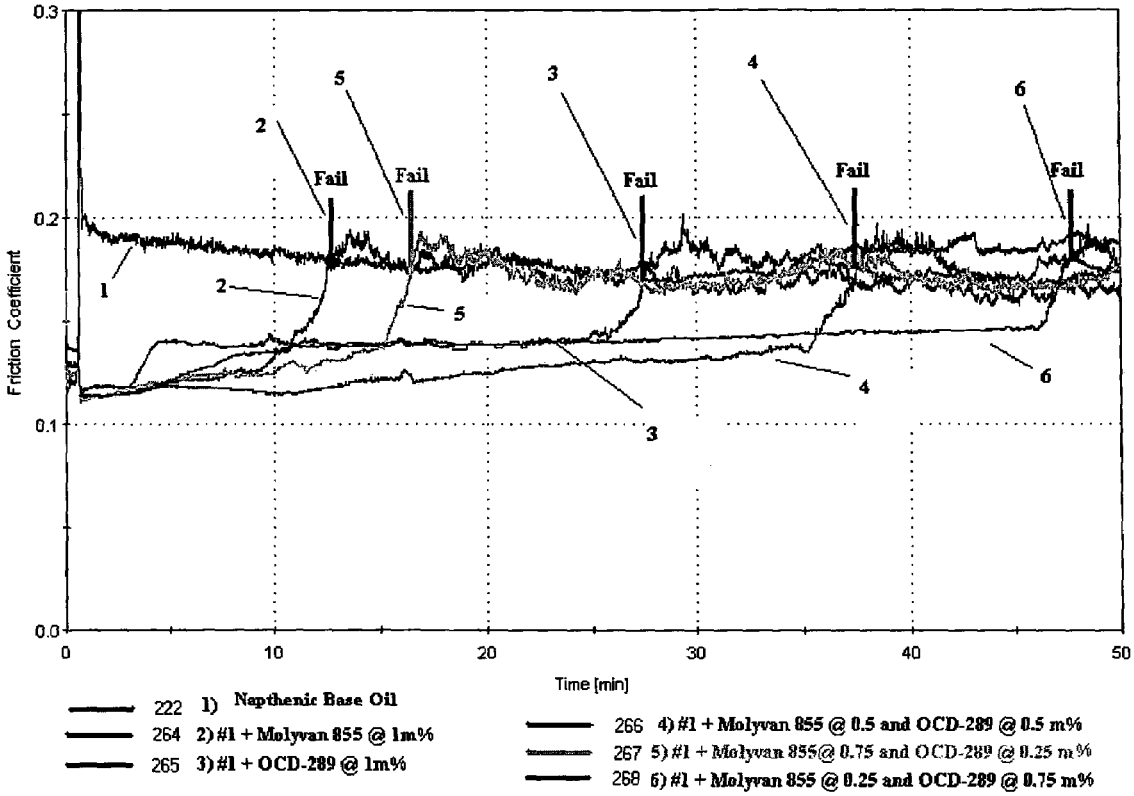
FIG. 1 is a graph showing the evaluation of friction reduction of non-sulfur molybdenum amide complex with organo borate ester composition, by ASTM D5707.

The organo borate ester composition of the invention comprises borated as well as non-borated compounds. It is believed that both the borated compounds and the non-borated compounds in the borate ester composition play an important role in the synergistic composition. A preferred borate ester composition is the reaction product obtained by reacting about 1 mole fatty oil, about 1.0 to 2.5 moles diethanolamine followed by subsequent reaction with boric acid to yield about 0.1 to 3 percent boron by mass. It is believed that the reaction products may include one or both of the following two primary components, with the further listed components being possible components when the reaction is pushed toward full hydration:

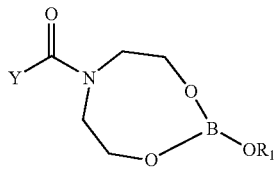

and/or

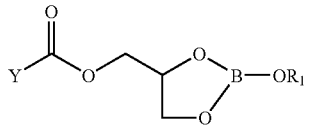

where $R_1$=H or $C_xH_y$ where x=1 to 60, and y=3 to 121

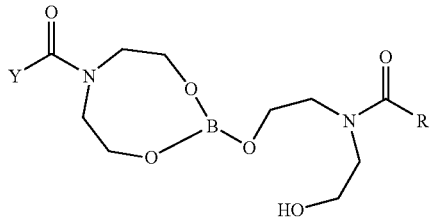

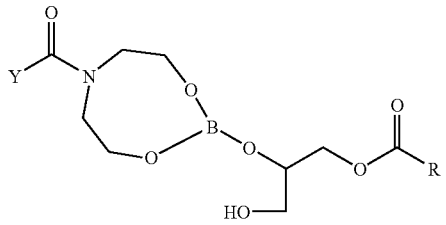

-continued

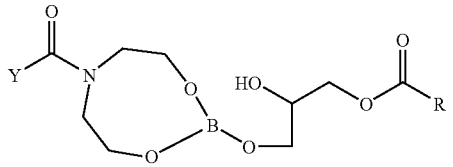

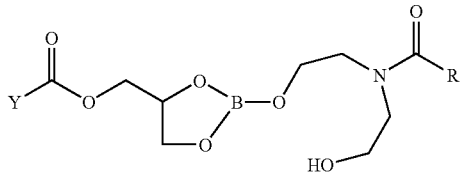

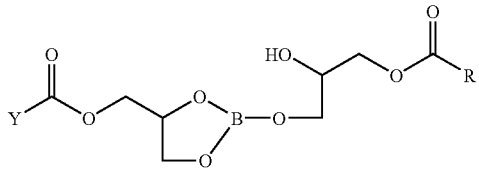

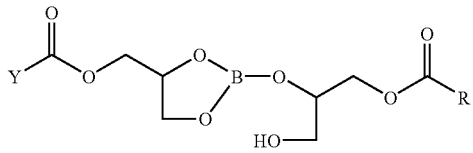

wherein Y represents a fatty oil residue. The preferred fatty oils are glyceryl esters of higher fatty acids containing at least 12 carbon atoms and may contain 22 carbon atoms and higher. Such esters are commonly known as vegetable and animal oils. Vegetable oils particularly useful are oils derived from coconut, corn, cottonseed, linseed, peanut, soybean and sunflower seed. Similarly, animal fatty oils such as tallow may be used.

The source of boron is boric acid or materials that afford boron and are capable of reacting with the intermediate reaction product of fatty oil and diethanolamine to form a borate ester composition.

While the above organo borate ester composition is specifically discussed above, it should be understood that other organo borate ester compositions should also function with similar effect in the present invention, such as those set forth in U.S. patent application Publication No. 2003/0119682, which is incorporated herein by reference. In addition, dispersions of borate salts, such as potassium borate, may also be useful.

As set forth in more detail below, a lubricant additive of the invention comprises an organo borate compound in combination with a sulfur-containing compound or a non-sulfur molybdenum compound, as components (i) through (vi) discussed above.

These non boron compounds above are known to possess certain lubricating properties such as oxidation, wear and corrosion inhibition in various lubricating media. Sometimes, however, the sulfur compounds alone do not provide adequate antiwear protection for the varied heavy duty applications of many industrial and automotive lubricants.

Moreover, under certain conditions, the high concentrations of sulfur compounds may produce an adverse effect on the overall performance of the lubricant. For instance, the so called sulfur donors may produce undesirably large amounts of sulfur compounds on certain protected surface or catalytic converters.

As for the non-sulfur molybdenum compound (vi), there is a desire to improve the already good antiwear properties and friction reduction properties Unexpectedly, the above sulfur compounds and non-sulfur molybdenum compounds produce synergistic antiwear effect when combined with a borate ester composition in certain ratios. The borate ester synergism manifests higher antiwear protection.

In addition, to the two synergistic antiwear components described above, the skilled person will understand that a fully formulated composition for use as contemplated by this invention may contain one or more of the following:

(1) borated and/or non-borated dispersants, (2) antioxidants, (3) seal swell compositions, (4) friction modifiers, (5) extreme pressure/antiwear agents, (6) viscosity modifiers, (7) pour point depressants, (8) detergents, (9) antifoamants.

1. Borated and/or Non-Borated Dispersants. Non-borated ashless dispersants may be incorporated within the final fluid composition in an amount comprising up to 10 mass percent on an oil-free basis. Many types of ashless dispersants listed below are known in the art. Borated ashless dispersants may also be included.

(a) "Carboxylic dispersants" are reaction products of carboxylic acylating agents (acids, anhydrides, esters, etc.) containing at least about 34 and preferably at least about 54 carbon atoms are reacted with nitrogen-containing compounds (such as amines), organic hydroxy compounds (such aliphatic compounds including monohydric and polyhydric alcohols, or aromatic compounds including phenols and naphthols), and/or basic inorganic materials. These reaction products include imide, amide, and ester reaction products of carboxylic acylating agents. Examples of these materials include succinimide dispersants and carboxylic ester dispersants.

The carboxylic acylating agents include alkyl succinic acids and anhydrides wherein the alkyl group is a polybutyl moiety, fatty acids, isoaliphatic acids (e.g. 8-methyl-octadecanoic acid), dimer acids, addition dicarboxylic acids (addition (4+2 and 2+2) products of an unsaturated fatty acid with an unsaturated carboxylic reagent), trimer acids, addition tricarboxylic acids (e.g., Empol® 1040, Hystrene® 5460 and Unidyme® 60), and hydrocarbyl substituted carboxylic acylating agents (from olefins and or polyalkenes). In one embodiment, the carboxylic acylating agent is a fatty acid. Fatty acids generally contain from about 8 up to about 30, or from about 12 up to about 24 carbon atoms. Carboxylic acylating agents are taught in U.S. Pat. Nos. 2,444,328; 3,219,666; and 4,234,435, which are hereby incorporated by reference.

The amine may be a mono- or polyaminc. The monoamines generally have at least one hydrocarbyl group containing 1 to about 24 carbon atoms, preferably with from 1 to about 12 carbon atoms. Examples of monoamines include fatty ($C_{8-30}$) amines, primary ether amines (SURFAM® amines), tertiary-aliphatic primary amines ("Primene"), hydroxyamines (primary, secondary or tertiary alkanol amines), ether N-(hydroxyhydrocarbyl)amines, and hydroxyhydrocarbyl amines ("Ethomeens" and "Propomeens"). The polyamines include alkoxylated diamines (Ethoduomeens), fatty diamines ("Duomeens"), alkylenepolyamines (ethylenepolyamines), hydroxy-containing polyamines, polyoxyalkylene polyamines (Jeffamines), condensed polyamines (a condensation reaction between at least one hydroxy compound with at least one polyamine reactant containing at least one primary or secondary amino group), and heterocyclic polyamines. Useful amines include those disclosed in U.S. Pat. Nos. 4,234,435 and 5,230,714 which are incorporated herein by reference.

Examples of these "carboxylic dispersants" are described in British Patent 1,306,529 and in many U.S. Patents including: U.S. Pat. Nos. 3,219,666; 3,316,177; 3,340,281; 3,351,552; 3,381,022; 3,433,744; 3,444,170; 3,467,668; 3,501,405; 3,542,680; 3,576,743; 3,632,511; 4,234,435; and Re 26,433 which are incorporated herein by reference.

(b) "Amine dispersants" are reaction products of relatively high molecular mass aliphatic or alicyclic halides and amines, preferably polyalkylene polyamines. Examples thereof are described in the following U.S. Pat. Nos. 3,275,554; 3,438,757; 3,454,555; and 3,565,804 which are incorporated herein by reference.

© "Mannich dispersants" are the reaction products of alkyl phenols in which the alkyl group contains at least about 30 carbon atoms with aldehydes (especially formaldehyde) and amines (especially polyalkylene polyamines). The materials described in the following U.S. Patents are illustrative: U.S. Pat. Nos. 3,036,003; 3,236,770; 3,414,347; 3,448,047; 3,461,172; 3,539,633; 3,586,629; 3,591,598; 3,634,515; 3,725,480; 3,726,882; and 3,980,569 which are incorporated herein by reference.

(d) Post-treated dispersants are obtained by reacting at carboxylic, amine or Mannich dispersants with reagents such as urea, thiourea, carbon disulfide, aldehydes, ketones, carboxylic acids, hydrocarbon-substituted succinic anhydrides, nitriles, epoxides. boron compounds, phosphorus compounds or the like. Exemplary materials of this kind are described in the following U.S. Pat. Nos. 3,200,107; 3,282,955; 3.367,943; 3,513,093; 3,639,242; 3,649,659; 3,442,808; 3,455,832; 3,579,450; 3,600,372; 3,702,757; and 3,708,422 which are incorporated herein by reference.

(e) Polymeric dispersants are interpolymers of oil-solubilizing monomers such as decyl methacrylate, vinyl decyl ether and high molecular mass olefins with monomers containing polar substituents, e.g. aminoalkyl acrylates or acrylamides and poly-(oxyethylene)-substituted acrylates. Examples of polymer dispersants thereof are disclosed in the following U.S. Pat. Nos. 3,329,658; 3,449,250; 3,519,656; 3,666,730; 3,687,849; and 3,702,300 which are incorporated herein by reference.

Borated dispersants are described in U.S. Pat. Nos. 3,087,936 and 3,254,025 which are incorporated herein by reference.

Also included as possible dispersant additives are those disclosed in U.S. Pat. Nos. 5,198,133 and 4,857,214 which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Antioxidants. Most oleaginous compositions will preferably contain a conventional quantity of one or more antioxidants in order to protect the composition from premature degradation in the presence of air, especially at elevated temperatures. Typical antioxidants include hindered phenolic antioxidants, secondary aromatic amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include orthoalkylated phenolic compounds such as 2,6-di-tertbutylphenol, 4-methyl-2,6-di-tertbutylphenol, 2,4,6-tri-tertbutylphenol, 2-tert-butylphenol, 2,6-diisopropylphenol, 2-methyl-6-tert-butylphenol, 2,4-dimethyl-6-tertbutylphenol, 4-(N,N-dimethylaminomethyl)-2,8-di-tertbutylphenol, 4-ethyl-2,6-di-tertbutylphenol, 2-methyl-6-styrylphenol, 2,6-distyryl-4-nonylphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically-hindered unbridged phenolic compounds. illustrative methylene-bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylenebis(2,6-di-tertbutylphenol), and similar compounds. Particularly preferred are mixtures of methylene-bridged alkylphenols such as are described in U.S. Pat. No. 3,211,652, all disclosure of which is incorporated herein by reference.

Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-t-naphthylamine, phenyl-β-napthylamine, alkyl- or aralkylsubstituted phenyl-β-naphthylamine containing one or two alkyl or aralkyl groups each having up to about 16 carbon atoms, alkyl- or aralkylsubstituted phenyl-p-naphthylamine containing one or two alkyl or aralkyl groups each having up to about 16 carbon atoms, and similar compounds.

A preferred type of aromatic amine antioxidant is an alkylated diphenylamine of the general formula:

$$R^{23}—(C_6H_4)—NH—(C_6H_4)—R^{24}$$

wherein $R^{23}$ is an alkyl group (preferably a branched alkyl group) having 8 to 12 carbon atoms, (more preferably 8 or 9 carbon atoms) and $R^{24}$ is a hydrogen atom, alkylaryl or an alkyl group (preferably a branched alkyl group) having 8 to 12 carbon atoms, (more preferably 8 or 9 carbon atoms). Preferred compounds are available commercially as Naugalube® 438L, 640, and 680 manufactured by Crompton Corporation. Other commercially available aromatic amine antioxidants include Vanlube® SL, DND, NA, 81, 961 and 2005 sold by the R.T. Vanderbilt Company, Inc. Another useful type of antioxidant for preferred inclusion in the compositions of this invention is comprised of one or more liquid, partially sulfurized phenolic compounds such as are prepared by reacting sulfur monochloride with a liquid mixture of phenols—at least about 50 mass percent of which mixture of phenols is composed of one or more reactive, hindered phenols—in proportions to provide from about 0.3 to about 0.7 gram molecules of sulfur monochloride per mole of reactive, hindered phenol so as to produce a liquid product. Typical phenol mixtures useful in making such liquid product compositions include a mixture containing by mass about 75% of 2,6-di-tert-butylphenol, about 10% of 2-tert-butylphenol, about 13% of 2,4,6-tri-tertbutylphenol, and about 2% of 2,4-di-tertbutylphenol. The reaction is exothermic and thus is preferably kept within the range of about 15° C. to about 70° C., most preferably between about 40° C. to about 60° C.

Mixtures of different antioxidants may also be used—One suitable mixture is comprised of a combination of (i) an oil-soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl) amine wherein the alkyl group is a branched alkyl group having 8 to 12 carbon atoms, the proportions of (i), (ii) and (iii) on a mass basis falling in the range of 3.5 to 5.0 parts of component (i) and 0.9 to 1.2 parts of component (ii) per part by mass of component (iii). The antioxidant discussion above is as put forth in U.S. Pat. No. 5,328,619, which is incorporated herein by reference.

Other useful preferred antioxidants are those disclosed in U.S. Pat. No. 4,031,023 which is incorporated by reference. The referenced antioxidants of the '023 patent are of the revised formula:

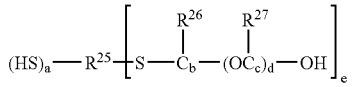

wherein $R^{25}$ is a hydrocarbyl or substituted hydrocarbyl containing up to about 30 carbon atoms and having a valence of a+e; $R^{26}$ and $R^{27}$ are independently selected from hydrogen and a hydrocarbon-based group of up to about 20 carbon atoms; b and c are independently from 2 to 5; d is from zero to 5; a is from zero to 4 and e is from 1 to 5 with the proviso that a +e is from 1 to 6, have increased resistance to oxidative degradation and antiwear properties. Antioxidants are preferably included in the composition at about 0.1-5 mass percent.

3. Seal Swell Compositions. Compositions which are designed to keep seals pliable are also well known in the art. A preferred seal swell composition is isodecyl sulfolane. The seal swell agent is preferably incorporated into the composition at about 0.1-3 mass percent. Substituted 3-alkoxysulfolanes are disclosed in U.S. Pat. No. 4,029,587 which is incorporated herein by reference.

4. Friction Modifiers. Friction modifiers are also well known to those skilled in the art. A useful list of friction modifiers are included in U.S. Pat. No. 4,792,410 which is incorporated herein by reference. U.S. Pat. No. 5,110,488 discloses metal salts of fatty acids and especially zinc salts and is incorporated herein by reference for said disclosures. Said list of friction modifiers includes fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines and mixtures thereof.

The preferred friction modifier is a borated fatty epoxide as previously mentioned as being included for its boron content. Friction modifiers are preferably included in the compositions in the amounts of 0.1-10 mass percent and may be a single friction modifier or mixtures of two or more.

Friction modifiers also include metal salts of fatty acids. Preferred cations are zinc, magnesium, calcium, and sodium and any other alkali, or alkaline earth metals may be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

5. Antiwear/Extreme Pressure Agents. The following are optional additives known for their ability to impart antiwear and/or extreme pressure properties. Some of these additives, including 5(i) and 5(iv) below, also form part of the present invention as providing synergistic results in combination with borated esters. As shown in the experimental data, the properties achieved in the claimed combination are far superior to those obtained with these additives alone. Nevertheless, the skilled person may choose to utilize one or more of these additives along with the claimed combination.

(i) dialkyldithiophosphate succinates of the structural formula (VI)

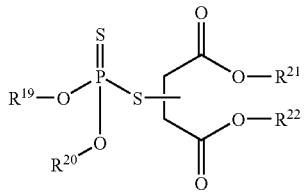

wherein $R^{19}$, $R^{20}$ and $R^{21}$ and $R^{22}$ are independently selected from alkyl groups having 3 to 8 carbon atoms (commercially available as VANLUBE 7611M, from R. T. Vanderbilt Co., Inc.), (ii) dithiophosphoric acid esters of carboxylic acid of the formula

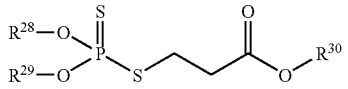

wherein $R^{28}$ and $R^{29}$ are alkyl having 3 to 8 carbon atoms and $R^{30}$ is alkyl having 2 to 8 carbon atoms (commercially available as Irgalube 63 from Ciba Geigy Corp.), and (iii) triphenylphosphorothionates of the formula

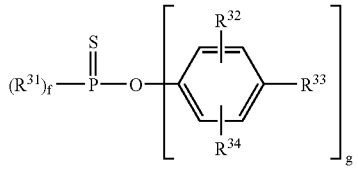

wherein f=1-2, m=2-3, $R^{31}$ is alkyl having 1 to 20 carbon atoms, $R^{32}$, $R^{33}$, and $R^{34}$ are independently hydrogen or alkyl groups (commercially available as Irgalube® TPPT from Ciba Geigy Corp.);

(iv) methylene bis(dialkyldithiocarbamate) wherein the alkyl group contains 4 to 8 carbon atoms (commercially available as VANLUBE 7723® from R.T. Vanderbilt Co., Inc.).

(v) Phosphorus acid. The lubricating compositions can also preferably include at least one phosphorus acid, phosphorus acid salt, phosphorus acid ester or derivative thereof including sulfur-containing analogs preferably in the amount of 0.002-1.0 mass percent. The phosphorus acids, salts, esters or derivatives thereof include compounds selected from phosphorus acid esters or salts thereof, phosphites, phosphorus-containing amides, phosphorus-containing carboxylic acids or esters, phosphorus-containing ethers and mixtures thereof.

In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids.

(vi) Another class of compounds useful to the invention are dithiophosphoric acid esters of carboxylic acid esters. Preferred are alkyl esters having 2 to 8 carbon atoms, as for example 3-[[bis(1-methylethoxy)phosphinothioyl]thio]propionic acid ethyl ester (vii) A preferred group of phosphorus compounds are dialkyphosphoric acid mono alkyl primary amine salt as represented by the formula

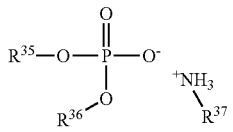

where $R^{35}$, $R^{36}$ and $R^{37}$ are independently hydrogen or alkyl (hydrocarbyl) groups. Compounds of this type are described in U.S. Pat. No. 5,354,484, which is herein incorporated by reference.

Eighty-five percent phosphoric acid is the preferred compound for addition to the fully formulated ATF package and is preferably included at a level of about 0.01-0.3 mass percent based on the mass of the ATF. The synergistic amine salts of alkyl phosphates are prepared by known methods, e.g. a method disclosed in U.S. Pat. No. 4,130,494, which is herein incorporated by reference. A suitable mono- or di-ester of phosphoric acid or their mixtures is neutralized with an amine. When mono-ester is used, two moles of the amine will be required, while the diester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono- or diesters. The amines can be selected from primary or secondary amines. Particularly preferred are tert-alkyl amines having 10 to 24 carbon atoms. These amines are commercially available as for example Primene® 81R manufactured by Rohm and Haas Co.

Zinc salts are preferably added to lubricating compositions in amounts of 0.1-5 mass percent to provide antiwear protection. The zinc salts are preferably added as zinc salts of phosphorodithioic acids or dithiocarbamic acid. Among the preferred compounds are zinc diisooctyl dithiophosphate and zinc dibenzyl dithiophosphate and amyl dithiocarbamic acid. Also included in lubricating compositions in the same mass percent range as the zinc salts to give antiwear/extreme pressure performance is dibutyl hydrogen phosphite (DBPH) and triphenyl monothiophosphate, and the thiocarbamate ester formed by reacting dibutyl amine-carbon disulfide- and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference.

Antimony or lead salts may also be used for extreme pressure. The preferred salts are of dithiocarbamic acid such as antimony diamyldithiocarbamate.

6. Viscosity Modifiers. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

Examples of commercially available VMs, DVMs and their chemical types are listed below. The DVMs are designated by a (D) after their number.

| VISCOSITY MODIFIER | TRADENAME AND COMMERCIAL SOURCE | |
|---|---|---|
| 1. Polyisobutylenes | Indopol ® | Amoco |
| | Parapol ® | Exxon (Paramins) |
| | Polybutene ® | Chevron |
| | Hyvis ® | British Petroleum |
| 2. Olefin copolymers | Lubrizol ® 7060, 7065, 7067 | Lubrizol |
| | Paratone ® 8900, 8940, 8452, 8512 | Exxon |
| | ECA-6911 | Exxon (Paramins) |
| | TLA 347, 555(D), 6723(D) | Texaco |
| | Trilene ® CP-40, CP-60 | Uniroyal |
| 3. Hydrogenated styrene-diene copolymers | Shellvis ® 50, 40 | Shell |
| | LZ ® 7341, 7351, 7441 | Lubrizol |
| 4. Styrene, maleate copolymers | LZ ® 3702(D), 3715. 3703(D) | Lubrizol |
| 5. Polymethacrylates (PMA) | Viscoplex ® Series 6 & 8 | Rohm RohMax |
| | TLA 388, 407, 5010(D), 5012(D) | Texaco |
| | Viscoplex ® 4-950(D), 6-500(D), 1515(D) | Rohm RohMax |
| 6. Olefin-graft-PMA polymer | Viscoplex ® 2-500, 2-600 | Rohm RohMax |
| 7. Hydrogenated polyisoprene star polymers | Shellvis ® 200, 260 | Shell |

Recent summaries of viscosity modifiers can be found in U.S. Pat. Nos. 5,157,088; 5,256,752; and 5,395,539 which are herein incorporated by reference for disclosure pertinent to this invention. The VMs and/or DVMs preferably are incorporated into the fully-formulated compositions at a level of up to 10% by mass.

7. Pour Point Depressants. These components are particularly useful to improve low temperature qualities of a lubricating oil. A preferred pour point depressant is an alkylnaphthalene. Pour point depressants are disclosed in U.S. Pat. Nos. 4,880,553 and 4,753,745, which are incorporated herein by reference. PPDs are commonly applied to lubricating compositions to reduce viscosity measured at low temperatures and low rates of shear. The pour point depressants are preferably used in the range of 0.1-5 mass percent. Examples of tests used to assess low temperature low shear-rate rheology of lubricating fluids include ASTM D97 (pour point), ASTM D2983 (Brookfield viscosity), D4684 (Mini-rotary Viscometer) and D5133 (Scanning Brookfield).

Examples of commercially available pour point depressants and their chemical types are:

| POUR POINT DEPRESSANT SOURCE | TRADENAME AND COMMERCIAL SOURCE | |
|---|---|---|
| 1. Polymethacrylates | Viscoplex ® Series 1, 9, 10 | Rohm RohMax |
| | LZ ® 7749B, 7742, 7748 | Lubrizol |
| | TC 5301, 10314 | Texaco |
| | Viscoplex ® 1-31, 1-330, 5-557 | Rohm GmbH |
| 2. Vinyl acetate/fumarate or maleate copolymers (Paramins) | ECA 11039, 9153 | Exxon |
| 3. Styrene, maleate copolymers | LZ ® 6662 | Lubrizol |

8. Detergents. Lubricating compositions in many cases also preferably include detergents. Detergents as used herein are preferably metal salts of organic acids. The organic acid portion of the detergent is preferably a sulphonate, carboxylate, phenate, salicylate. The metal portion of the detergent is preferably an alkali or alkaline earth metal. Preferred metals are sodium, calcium, potassium and magnesium. Preferably, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should preferably contain on average from about 10 to about 40 carbon atoms, more preferably from about 12 to about 36 carbon atoms and most preferably from about 14 to about 32 carbon atoms on average. Similarly, the phenates, oxylates and carboxylates preferably have a substantially oleophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The most preferred component is thus an overbased monosulfonated alkylated benzene, and is preferably the monoalkylated benzene. Preferably, alkyl benzene fractions are obtained from still bottom sources and are mono- or di-alkylated. It is believed, in the present invention, that the mono-alkylated aromatics are superior to the dialkylated aromatics in overall properties.

It is preferred that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant.

It is preferred that the salt be "overbased". By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Preferably, the excess metal will be present over that which is required to neutralize the acids at about in the ratio of up to about 30:1, preferably 5:1 to 18:1 on an equivalent basis.

The amount of the overbased salt utilized in the composition is preferably from about 0.1 to about 10 mass percents on an oil free basis. The overbased salt is usually made up in about 50% oil with a TBN range of 10-600 on an oil free basis. Borated and non-borated overbased detergents are described in U.S. Pat. Nos. 5,403,501 and 4,792,410 which are herein incorporated by reference for disclosure pertinent hereto.

9. Anti-foamant. Antifoaming agents are well-known in the art as silicone or fluorosilicone compositions. Such antifoam agents are available from Dow Coming Chemical Corporation and Union Carbide Corporation. A preferred fluorosilicone antifoam product is Dow FS-1265. Preferred silicone antifoam products are Dow Coming DC-200 and Union Carbide UC-L45. Other antifoam agents which may be included in the composition either alone or in admixture is a polyacrylate anti-foamer available from Monsanto Polymer Products Co. of Nitro, W. Va. known as PC-1244. Also, a siloxane polyether copolymer anti-foamer available from OSI Specialties, Inc. of Farmington Hills, Mich. and may also be included. One such material is sold as SILWET-L-7220. The antifoam products are preferably included in the compositions of this invention at a level of 5 to 80 parts per million with the active ingredient being on an oil-free basis.

The synergistic compositions may be incorporated in any lubricating media by known methods. The compositions impart antiwear and extreme pressure properties to natural and synthetic lubricants formulated as oils or greases.

The base oils employed as lubricant vehicles are typical natural and synthetic oils used in automotive and industrial applications (API base stock category Groups I, II, III, IV, V) such as, among others, turbine oils, hydraulic oils, gear oils, crankcase oils and diesel oils. Natural base oils include mineral oils, petroleum oils, paraffinic oils and the ecologically desirable vegetable oils. Typical synthetic oils include ester-type oils such as silicate esters and pentaerythritol esters, hydrogenated mineral oils, silicones and silanes.

The additive composition of the invention comprises (a) an organoborate ester composition and (b) a compound chosen from among an organic sulfur containing compound, an organic phosphorus containing compound and a non-sulfur organo molybdenum compound. The components (a) and (b) may be present in a ratio of between about 1:15 to about 15:1.

The compositions of the invention may be incorporated in the lubricant in an amount effective to produce the desired antiwear characteristics. An amount from about 0.1 to 10.0 percent will be sufficient for most applications. A preferred range is from about 0.5 to about 3.0 percent by mass of the total lubricant composition, with a most preferred range being from about 0.7 to about 1.5 percent by mass.

The lubricating compositions may contain other conventional additives depending on the intended use of the lubricant. The grease formulations may contain various thickening agents such as, among others, silicate minerals, metal soaps and organic polymers.

The following examples are given for the purpose of illustrating the invention and are not intended in any way to limit the invention. All percentages and parts are based on mass unless otherwise indicated.

EXPERIMENTAL DATA

EXAMPLE 1A

Preparation of OCD-289 Borated Diol Mixture

OCD-289 Borated Diol (organo borate ester composition) mixture is made by partially borating a mixture of [C8-18 fatty acid residue] diethanol amide (75%) and [C8-18 fatty acid residue] monoglyceride (22%), borated to a level of 1%. This level of boration affords motor oil solubility. The Example 1 formulation is the basis of the testing in Tables 1 and 2 below.

Preparation:

1. To a 500 ml one neck flask, 14.3 g. of boric acid and 247.5 g. of OD-896 were added. OD-896 is the reaction product of a fatty oil with diethanolamine, and is available from R.T. Vanderbilt Company, Inc.
2. Attached the flask to a vacuum evaporator and started rotating at moderate speed at room temperature until boric acid became uniformly dispersed in OD-896.
3. Applied vacuum onto the flask to remove entrapped air from the mixture.
4. Gradually heated the mixture to 65 C. for 1 hour to remove initial water.
5. Continued heating the mixture to 95 C. for 4 hours to remove residual water.
6. Filtered the product at 80 C. before packaging.

EXAMPLE 1B

Preparation of OCD-289 (Neat, 1% Boron) Butanol Process

Preparation:

1. To a 500 ml 3-neck flask, 5.78 g. of boric acid, 100.0 g. of OD-896NT and 40.0 g. butanol were added.
2. Turned on an agitator and mixed at moderately high speed until boric acid was uniformly dispersed in the OD-896NT/butanol solution.
3. Gradually heated the mixture to 95 C. for 3 hours to remove initial water.
4. Continued heating the mixture to a reflux temperature at 130 C. for 3 hours to remove residual water.
5. Increased the temperature to 150 C. and applied vacuum onto the flask for 2 hours to remove residual butanol.
6. Filtered the product at 110 C. before packaging.

EXAMPLE 1C

Preparation of OCD 289

1. To a 2 liter three neck round-bottomed flask was added 1103.0 g of OD 896 and 71.05 g of boric acid. OD 289 is the reaction product of a fatty oil with a diethanolamine, and is available from R.T. Vanderbilt Company, Inc.
2. The flask was equipped with a Dean Stark Trap, condenser, thermometer and a mechanical stirrer.
3. The entire apparatus was placed under approximately 50 mm Hg pressure, and heated to 130 C.
4. Water was collected over a period of between 5-7 hours at 130 C.
5. The reaction was cooled to about 80 C, and 123.5 g of napthenic base oil was added while stirring, then filtered while still warm to give a yellow liquid.

EXAMPLE 2A

OCD-289 with a 10% Oil Content

The pour point of the borated product can be improved by replacing 10% of the diol starting material (which is in excess) with napthenic base oil and borating to a 1% level as in Example 1.

Preparation:

A. To a 500 ml. one neck flask, 17.2 g. Boric acid, 267.0 g. OD-896 and 30.0 g. Napthenic base oil were added.
B. Attached the flask to a vacuum evaporator and started rotating at moderate speed at room temperature until boric acid became uniformly dispersed in OD-896 and Uninap oil.
C. Applied vacuum onto the flask to remove entrapped air from the mixture.
D. Gradually heated the to 65 C. for 1 hour to remove initial water.
E. Continued heating the mixture to 95 C. for 4 hours to remove residual water.
F. Filtered the product at 80 C. Before packaging.

EXAMPLE 2B

Preparation of OCD-289 (with 10% Oil, 1% B)
Butanol Process

Preparation:

A. To a 500 ml. 3-neck flask, 5.78 g. Boric acid, 90.0 g. OD-896NT, 10.0 g. Napthenic base oil and 40 g. butanol were added.
B. Turned on an agitator and mixed at moderately high speed until boric acid was uniformly dispersed in the OD-896NT/butanol solution.
C. Gradually heated the mixture to 95 C. for 3 hours to remove initial water.
D. Continued heating the mixture to a reflux temperature at 130 C. for 3 hours to remove residual water.
E. Increased the temperature to 150 C. and applied vacuum onto the system for 2 hours to remove residual butanol.
F. Filtered the product at 110 C. before packaging.

The processes of Examples 1B and 2B make the same compound as their counterparts in Examples 1A and 2A, but the storage stability of the product is improved since the reaction can more easily be driven to completion. Likewise, Example 1C parallels 1A and 1B, but is the preferred method. While some of the testing in Tables 1-4 derives from the A, B or C processes for making borated ester, the performance in the lubricant is the same regardless of the manufacture process. The processes of Examples 1B and 2B are essentially following the teaching of U.S. Pat. No. 4,389,322, which is incorporated by reference.

The examples are based on a 1% boron presence in the borated ester. It is believed that there will be advantages to having up to 3% boron, and the maximum theoretical amount of boron is believed to be about 3.68%. Though the current examples are all based on 1% boron, it should be understood that levels of boron up to 3% or more in the borated ester should work equally well or better. In terms of economy and viscosity, a composition generally about 0.8-1.2% boron is preferred, with about 1% boron being particularly preferred.

The organo borate ester compositions prepared from the above process are believed to contain the following two reaction products. If the reaction is pushed to full hydration, then it is believed that some or all of the additional reaction products set out below may also be present.

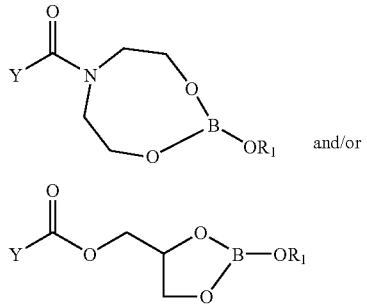

where $R_1$=H or $C_xH_y$ where x=1 to 60, and y=3 to 121

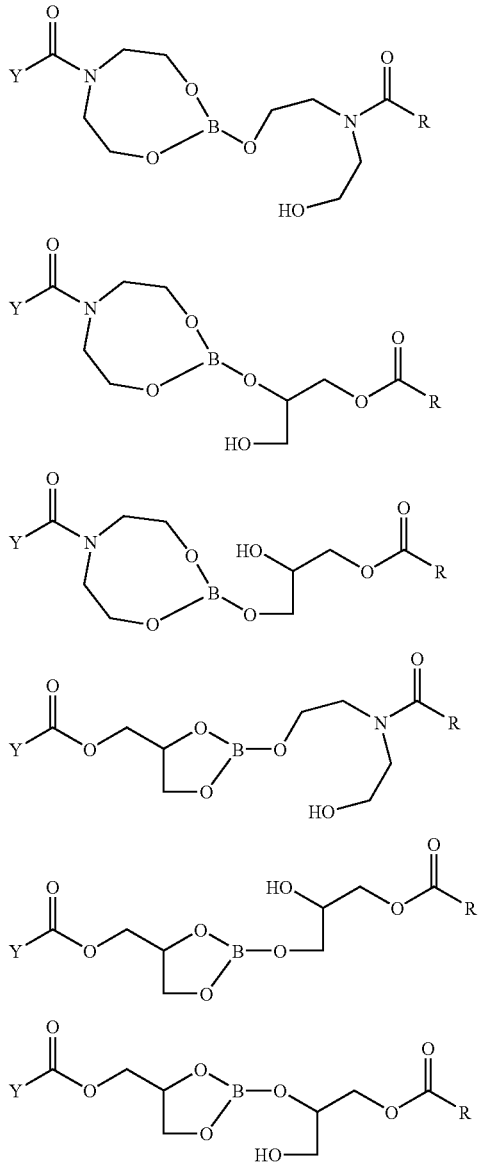

Laboratory tests were conducted by using a original Falex machine to simulate the valve train wear of an automobile engine. The V-blocks and pin were washed in mineral spirits with an ultrasonic cleaner, rinsed with acetone, air dried and weighed. The test sample (60 g) was placed into the oil cup. The motor was switched on and the loading arm was placed on the ratchet wheel. Upon reaching the reference load of 227 kg, the ratchet wheel was disengaged and the load was maintained constant for 3.5 hours. Thereafter, the motor was switched off. The V-blocks and pin were washed, dried and weighed. The mass loss, a measure of wear, was recorded and compiled below. For testing conditions, a FAIL is considered to be any test which did not run for 60 minutes, because of excessive wear or high torque, i.e. where the load could not be maintained. For FAIL tests, mass loss is not relevant and therefore not shown.

Table A shows test results for the borated diol (borated ester) sample OCD-289 alone in a base oil. It can be seen that failure (or at least inconsistent results) occur at borated diol levels of 0.7 mass % or lower. Only at levels of 0.8 mass % or greater, are consistent good results achieved. Therefore, it is surprising that excellent levels of wear resistance can be achieved with borated diol at lower levels, when combined with certain additive compounds. Table B shows broadly that a low level of 0.35% borated diol, combined with additive compounds such as phosphorodithioate(Lubrizol® 1395), phosphorodithioate ester(Vanlube® 7611 M), dithiocarbamate (Molyvan® 822) and bisdithiocarbamate (Vanlube® 7723), can provide excellent antiwear protection. More detailed data for these and other additives are set out below in Tables 1-4. From this data, it can be seen that the antiwear protection is far superior in the synergistic combination, than the use of either of the components separately.

As various embodiments of the invention are described below, it is important to understand the context within which the borate ester composition was expected to perform under antiwear test conditions, i.e. while OCD-289 showed relatively good antiwear activity (see test 1 from Table 1), this was achieved only at higher mass percentage levels. Decreasing the amount of OCD-289 leads to significantly inferior antiwear performance (see test 10 from Table 1). One aspect of the surprising results which were achieved was that it was possible to lower the amount of borate ester composition to levels normally associated with poor antiwear performance and still obtain excellent antiwear results by adding the additional components described in the invention.

In a first embodiment, the invention relates to an additive composition comprising an organo borate ester composition in combination with 1,3,4-thiadiazole compounds of the formula (I):

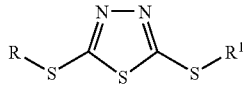

(I)

wherein R and $R^1$ are independently selected from hydrogen and $C_{8-12}$ thioalkyl or hydrogen, $C_{1-22}$-alkyl groups, terpene residue and maleic acid residue of the formula:

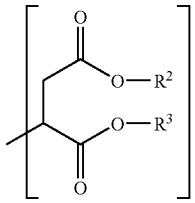

and $R^2$ and $R^3$ represent $C_{1-22}$-alkyl and $C_{5-7}$-cycloalkyl groups, R or $R^1$ and either $R^2$ or $R^3$ may be hydrogen.

The 1,3,4-thiadiazoles of formula I may be prepared by the method disclosed in U.S. Pat. Nos. 4,761,842 and 4,880,437 which are incorporated herein by reference. Terpene residues are preferably derived from pinene and limonene.

The alkyl groups represented by R and $R^1$ contain preferably 1 to 22 carbon atoms and may be branched or straight chain. Particularly preferred are compounds wherein both alkyl groups together contain a total of at least 22 carbon atoms. Groups $R^2$ and $R^3$ in the formula I represent branched or straight chain alkyl groups containing 1 to 22 carbon atoms and cyclic aliphatic groups such as cyclohexyl, cyclopentyl and cycloheptyl.

A particular thiadiazole compound tested was butanedioic acid ((4,5-dihydro-5 thioxo-1,3,4-thiadiazol-2-yl) thio)-bis (2-ethylhexyl) ester, available as Vanlube® 871 from R.T. Vanderbilt Company, Inc. The results are set forth in Table 2 below. It can be clearly seen that while the thiadiazole compound alone (test 12) does not impart sufficient antiwear protection, excellent results are obtained when used in combination with the organo borate ester composition.

Figure 2:
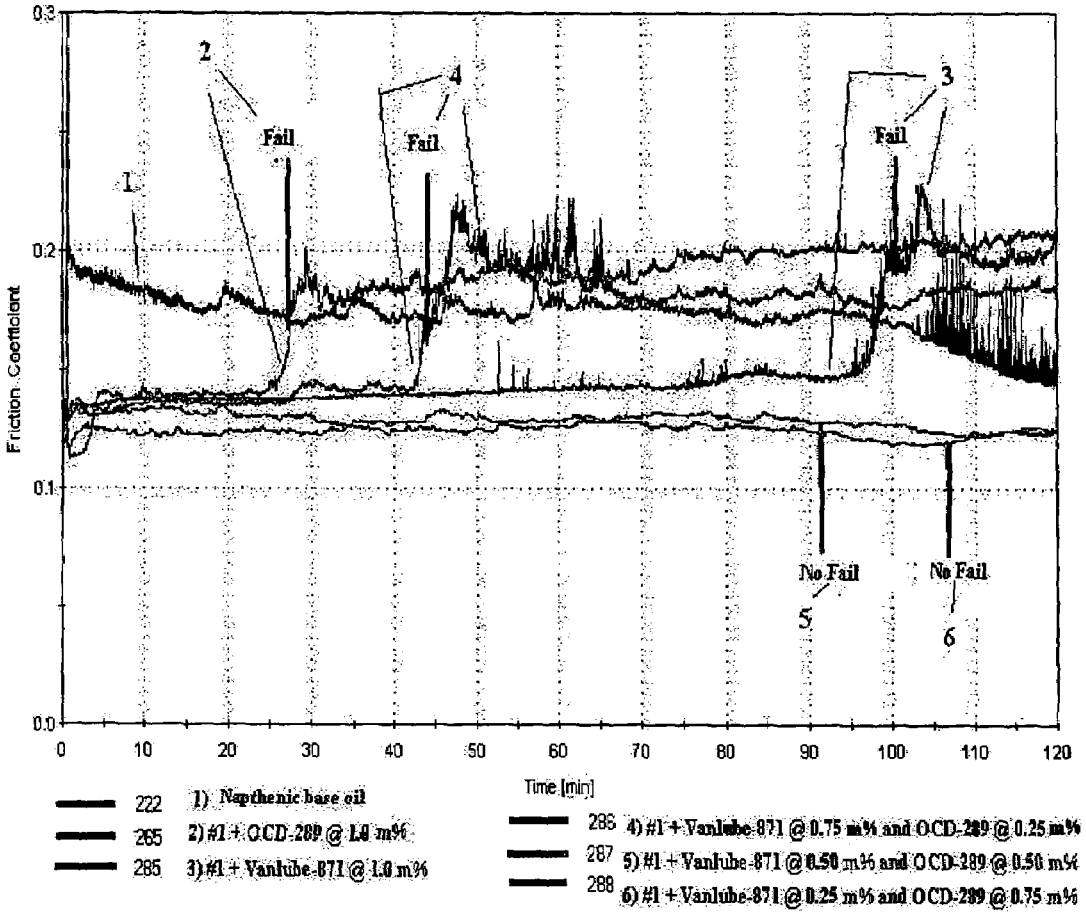
FIG. 2 is a graph showing the evaluation of friction reduction of thiadiazole with organo borate ester composition, by ASTM D5707.

Further testing of Vanlube® 871 is set forth in FIG. 2. The inventive additive combination was tested on the SRV machine (described in more detail below). The results show that when using OCD-289 with Vanlube® 871, the film strength is not broken for the length of the two hour test. While Vanlube® 871 resulted in a failure by itself, the combination with OCD-289 and Vanlube® 871 at various ratios yielded a marked improvement. So, film strength achieved by thiadiazoles such as Vanlube® 871 can be greatly enhanced in combination with organo borate ester composition at appropriate ratios of borate ester composition: thiadiazole. In one embodiment of combining borate ester compositions with thiadiazole, the borate ester composition:thiadiazole ratio is from about 1:3 to about 15:1. In another embodiment combining borate ester composition with thiadiazole, the borate ester composition:thiadiazole ratio is from about 3:7 to about 9:1.

A second embodiment of the invention relates to an additive composition comprising an organo borate ester composition in combination with bisdithiocarbamate compounds of the formula (II):

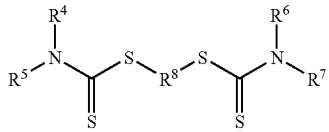

(II)

wherein $R^4$, $R^5$, $R^6$, and $R^7$ are aliphatic hydrocarbyl groups having 1 to 13 carbon atoms and $R^8$ is an alkylene group having 1 to 8 carbon atoms.

The bisdithiocarbamates of formula (II) are known compounds described in U.S. Pat. No. 4,648,985, incorporated herein by reference. The compounds are characterized by groups $R^4$ to $R^7$ which are the same or different and are hydrocarbyl groups having 1 to 13 carbon atoms. Preferred are branched or straight chain alkyl groups having 1 to 8 carbon atoms. The group $R^8$ is an aliphatic group such as straight and branched alkylene groups containing 1 to 8 carbons. Particularly preferred is methylenebis (dibutyldithiocarbamate) available commercially under the trademark Vanlube® 7723 from R.T. Vanderbilt Company, Inc.

The bisdithiocarbamate Vanlube® 7723 was tested, with results set forth in Table 4. It can be clearly seen that while the bisdithiocarbamate does not provide sufficient antiwear protection when used alone (test 29), excellent results are achieved when used in combination with the organo borate ester composition, identified as OCD-289. In one embodiment for the combining borate ester composition and bisdithiocarbamates, the ratio of borate ester composition:bisdithiocarbamate is about 1:6 to about 15:1. In another embodiment for the combining borate ester composition and bisdithiocarbamates, the ratio of borate ester composition: bisdithiocarbamate is about 1:4 to about 9:1.

A third embodiment of the invention relates to an additive composition comprising an organo borate ester composition in combination with dithiocarbamates of the formula (III):

(III)

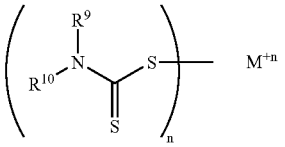

wherein $R^9$ and $R^{10}$ represent alkyl groups having 1 to 8 carbon atoms, M represents metals of the periodic groups IIA, IIIA, VA, VIA, IB, IIB, VIB, VIII and a salt moiety formed from an amine of the formula:

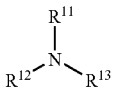

$R^{11}$, $R^{12}$ and $R^{13}$ being independently selected from hydrogen and aliphatic groups having 1 to 18 carbon atoms and n is the valence of M;

or the formula (IV):

(IV)

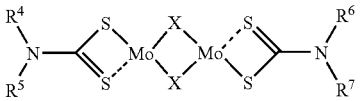

X = S or O where $R^4$, $R^5$, $R^6$, and $R^7$ are aliphatic hydrocarbyl groups having 1 to 13 carbon atoms and $R^8$ is an alkylene group having 1 to 8 carbon atoms.

The dithiocarbamates of the formula III are known compounds. One of the processes of preparation is disclosed in U.S. Pat. No. 2,492,314, which is incorporated by reference. Groups $R^4$ and $R^5$ in the formula III represent branched and straight chain alkyl groups having 1 to 8 carbon atoms. Particularly preferred are antimony and zinc dithiocarbamates.

Particular dithiocarbamate compounds tested herein (Table 3) are molybdenum dialklydithiocarbamate (Molyvan®822 available from R.T. Vanderbilt Company, Inc.) and zinc diamyldithiocarbamate (Vanlube®AZ (50% active), available from R.T. Vanderbilt Company, Inc.). As can be clearly seen, the dithiocarbamates does not provide sufficient antiwear protection when used alone, but provide excellent results when combined with borate ester composition. In one embodiment for the combining borate ester composition and dithiocarbamates, the ratio of borate ester composition: dithiocarbamate is about 1:15 to about 15:1. In another embodiment for the combining borate ester composition and dithiocarbamates, the ratio of borate ester composition: dithiocarbamate is about 1:9 to about 9:1. In yet another embodiment for the combining borate ester composition and dithiocarbamates, the ratio of borate ester composition: dithiocarbamate is about 2:1 to about 1:1.

A fourth embodiment of the invention relates to an additive composition comprising an organo borate ester composition in combination with phosphorodithioates of the formula (V):

(V)

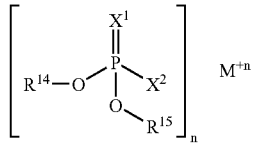

wherein $X^1$ and $X^2$ are independently selected from S and O, $R^{14}$ and $R^{15}$ represent hydrogen and alkyl groups having 1 to 22 carbon atoms, M represents metals of the periodic groups IIA, IIIA, VA, VIA, IB, IIB, VIB, VIII and a salt moiety formed from an amine of the formula:

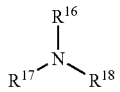

$R^{16}$, $R^{17}$ and $R^{18}$ being independently selected from hydrogen and aliphatic groups having 1 to 18 carbon atoms and n is the valence of M.

The phosphorodithioates (or dithiophosphates) of the formula (V) are known, commercially available materials. One of the processes of preparation is taught by U.S. Pat. No. 4,215,067, which is incorporated by reference. Groups $R^{14}$ and $R^{15}$ represent branched and straight chain alkyl groups having 1-22 groups and may be derived from fatty acids. Particularly preferred are zinc phosphorodithioates. The metal ion in formula III and IV may be selected from the following groups of the Periodic Table: IIA, IIIA, VA, VIA, IB, IIB, VIB and VIII. Amine salts of the compounds are also useful synergists of the invention. Exemplary, salts include, among others, those prepared from alkyl amines and mixed alkyl amines. Particularly useful are fatty acid amines.

Figure 3:
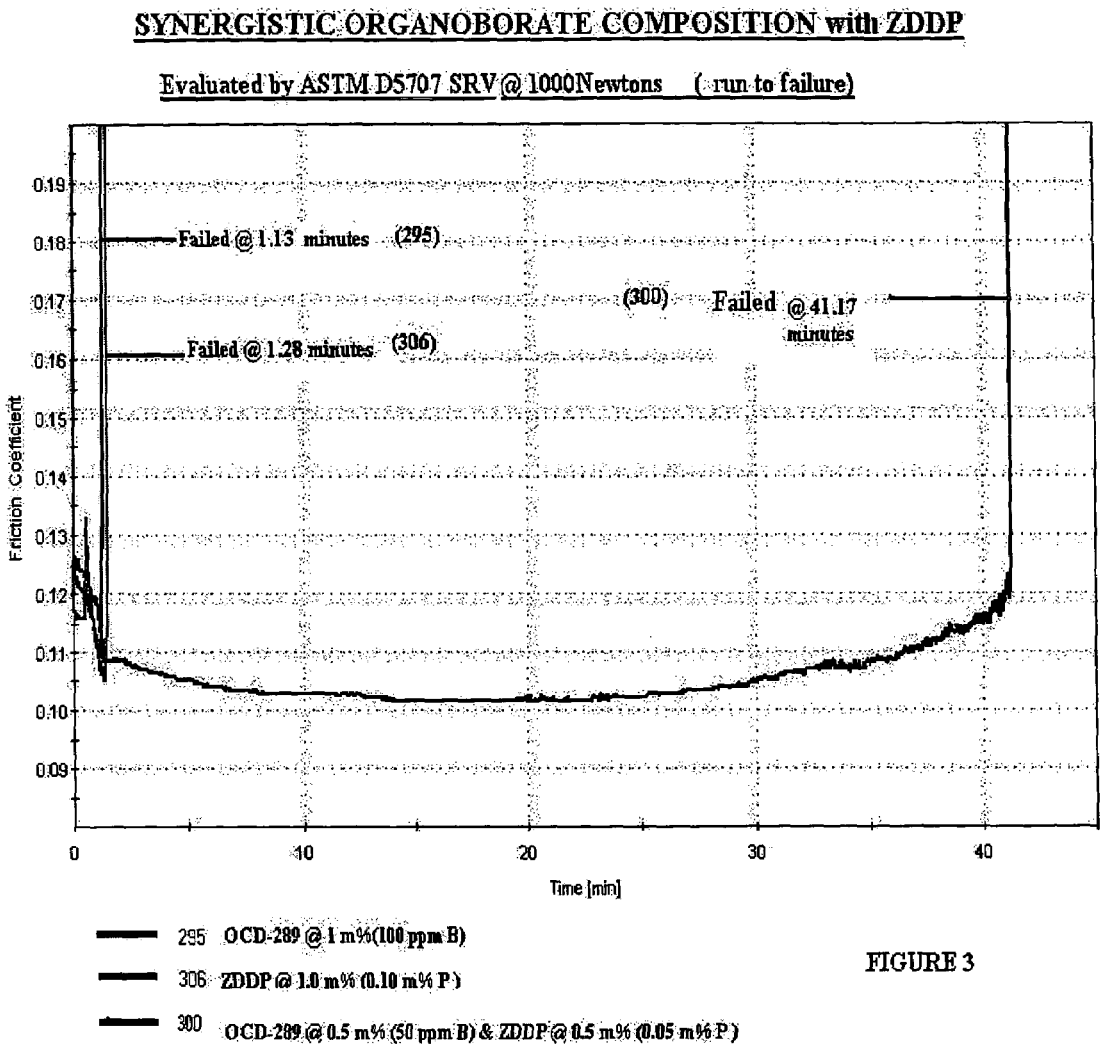
FIG. 3 is a graph showing the evaluation of zinc dithiophosphate with organo borate ester composition, by ASTM D5707.

A phosphorodithioate tested was a primary alkyl zinc dithiophosphate (Lubrizol® 1395 available from Lubrizol Corporation) with the results set out in Table 1. Although dithiophosphates are known to impart antiwear protection at sufficiently high levels of phosphorus, there is a movement in the industry away from such high levels. Therefore, there is an interest in achieving antiwear protection with low levels of phosphorus. It can seen that this combination is effective despite having very low levels of phosphorus, below 0.080% and even as low as 0.009% P, when the amount of dithiophosphate is present at less than 1 mass % of the base oil. FIG. 3 relates to a similar SRV test as set out in FIGS. 1 and 2, with certain different parameters as described in the FIG. 3 itself. Again, it is clearly shown that a composition of borate ester and ZDDP provides excellent results, whereas the borate ester of ZDDP alone fail this important test. In one embodiment for the combining borate ester composition and phosphorodithioates, the ratio of borate ester composition:phosphorodithioate is about 1:15 to about 15:1. In another embodiment for the combining borate ester composition and phosphorodithioates, the ratio of borate ester composition: phosphorodithioate is about 1:9 to about 9:1.

A fifth embodiment of the invention relates to an additive composition comprising an organo borate ester composition in combination with phosphorodithioate esters of the formula (VI):

(VI)

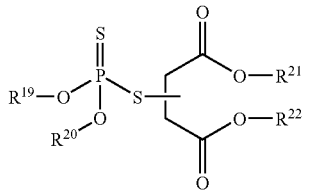

wherein $R^{19}$, $R^{20}$, $R^{21}$, and $R^{22}$ may be the same or different and are selected from alkyl groups having 1 to 8 carbon atoms.

The phosphorodithioate esters of the formula (VI) are known compounds. One of the processes of manufacture is disclosed in U.S. Pat. No. 3,567,638. Groups $R^{19}$, $R^{20}$, $R^{21}$, and $R^{22}$ in the formula (VI) may be the same or different and may be selected from branched and straight chain alkyl groups. Preferred are groups containing 1 to 8 carbon atoms.

A phosphorodithioate ester tested was a dialkyl dithiophosphate (Vanlube®7611 M, available from R.T. Vanderbilt Company, Inc.), with the results set out in Table 4. Although phosphorodithioate esters are known to impart antiwear protection at sufficiently high levels of phosphorus, there is a movement in the industry away from such high levels. Therefore, there is an interest in achieving antiwear protection with low levels of phosphorus. It is also seen that this combination is effective despite having very low levels of phosphorus, below 0.050% and even as low as 0.006% P, when the amount of dithiophosphate ester is present at less than 1 mass % of the base oil. In one embodiment for the combining borate ester composition and phosphorodithioate esters, the ratio of borate ester composition:phosphorodithioate ester is about 1:15 to about 15:1. In another embodiment for the combining borate ester composition and phosphorodithioate esters, the ratio of borate ester composition:phosphorodithioate ester is about 1:9 to about 9:1.

A sixth embodiment of the invention relates to an additive composition comprising an organo borate ester composition in combination with a non-sulfur molybdenum additive. Particularly preferred is that additive which is a sulfur- and phosphorus-free organic amide complex prepared by sequentially reacting fatty oil, diethanolamine and a molybdenum source by the condensation method described in U.S. Pat. No. 4,889,647, to obtain a product with up to 12 mass % molybdenum, incorporated herein by reference of the formula:

(VII)

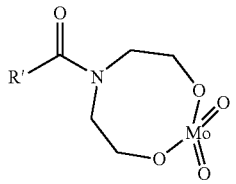

and/or

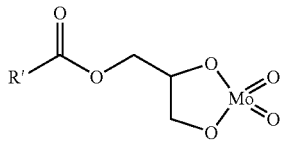

wherein R' is a fatty oil residue.

Molyvan®855 was tested in combination with organo borate ester composition, and the results are set forth in Table 3. Molyvan®855 is known to have excellent antiwear properties. However, it was surprising that the properties were even further enhanced when combined with borate ester composition. Comparing tests 20 and 21, it can be seen that decreasing the amount of Molyvan®855 leads to decreasing antiwear protection. Comparing tests 21 and 22, it can be seen that an equal amount of Molyvan®855 used alone, as compared to use in combination with borate ester composition, results in an almost 2-fold improvement in antiwear properties.

Further advantages of the synergy between Molyvan®855 and borate ester composition are shown in FIG. 1, in which friction and wear properties of lubricants were measured using a high-frequency, linear-oscillation (SRV) test machine according to ASTM D 5707. Using an SRV test machine, a steel ball oscillates under a constant load against a steel test disk. The friction coefficient of a drop of test lubricant interposed between the two surfaces is recorded.

Test Parameters for FIG. 1 and 2

| | |
|---|---|
| Test temperature, | 80° C. |
| Test break-in load, | N 50 (30 seconds) |
| Test load, | N 200 |
| Test frequency, | Hz 50 |
| Test stroke, mm | 1.00 |
| Test duration, min | 50 |
| Test ball material | 52100 steel, 60 ± 2 Rc hardness 0.025 ± 0.005 μm Ra surface finish, 10-mm diameter |

-continued

| Test Parameters for FIG. 1 and 2 | |
|---|---|
| Test disk material | 52100 steel, 60 ± 2 Rc hardness<br>0.45 to 0.65 μm Rz lapped surface,<br>24-mm diameter by 7.85 mm |

The 'fail' point is indicated as that point at which the friction coefficient increases to that of the oil alone. From FIG. 1, it can be seen that tests 4 and 6 (combined OCD-289 and Molyvan®855 corresponding to respective mass ratio of 1:1 and 3:1) show excellent friction reduction compared to either component used alone (tests 2 and 3 respectively).

In one embodiment for the combining borate ester composition and non-sulfur molybdenum additive, the ratio of borate ester composition:non-sulfur molybdenum additive is about 1:15 to about 15:1. In another embodiment for the combining borate ester composition and non-sulfur molybdenum additive, the ratio of borate ester composition:non-sulfur molybdenum additive is about 1:9 to about 9:1. In yet another embodiment for the combining borate ester composition and non-sulfur molybdenum additive, the ratio of borate ester composition:non-sulfur molybdenum additive is about 1:1 to about 3:1.

TABLE A

OCD-289 Performance on Test
Test: Falex Pin & Vee Block
Test Conditions: 500 lbs., 60 minutes
Base: Napthenic oil

| Treat Rate (Mass Percent) | Test Duration, minutes | Mass Loss, mg |
|---|---|---|
| 0.5 | 57 (failure) | FAIL |
| 0.6 | 60 | 39 |
| 0.6 | 60 | 28 |
| 0.7 | 5 (failure) | FAIL |
| 0.7 | 6 (failure) | FAIL |
| 0.8 | 60 | 30 |
| 0.9 | 60 | 27 |
| 1.0 | 60 | 23* |

*Average of 21 tests. Range 8.7-60.8 mg

TABLE B

Performance of OCD-289 With Other Additives
Test: Falex Pin & Vee Block
Test Conditions: 500 lbs., 60 minutes
Base: 99.3% Napthenic oil + 0.35% OCD-289 + 0.35% Other Additive

| Other Additive | Test Duration, minutes | Mass Loss, mg |
|---|---|---|
| LZ 1395 | 60 | 1.8 |
| LZ 1395 | 60 | 18 |
| MOLYVAN 822 | 60 | 39 |
| MOLYVAN 822 | 60 | 31 |
| VANLUBE 7723 | 60 | 43.6 |
| VANLUBE 7723 | 60 | 59.2 |
| VANLUBE 7611 M | 60 | 25.5 |
| VANLUBE 7611 M | 60 | 30.5 |

TABLE 1

OCD-289 With Other Additives Falex Pin & Vee Block Performance
Base: Napthenic oil

| | Mass Percent | | | | | | | | | | |
|---|---|---|---|---|---|---|---|---|---|---|---|
| | 1 | 2 | 3 | 4 | 5 | 6 | 7 | 8 | 9 | 10 | 11 |
| OCD-289 | 1.0 | | | | | | 0.5 | 0.9 | 0.1 | 0.5 | |
| LZ 1395 (ZDDP) | | 1.06 | | 1.5 | 2.0 | 5.0 | 0.5 | 0.1 | 0.9 | | 0.5 |
| OD-896B | | | 1.0 | | | | | | | | |
| % Phosphorus | 0 | 0.10 | 0 | 0.14 | 0.19 | 0.47 | .047 | .009 | 0.08 | 0 | .047 |
| Falex Pin & Vee Block (500 lb 60 Minutes) | | | | | | | | | | | |
| Duration min. | 60 | 7 s | 19 s | 13 s | 15 s | 47 | 60 | 60 | 60 | 40 | 2 s |
| s = seconds | | (5 s) | (15 s) | | | | | | | | |
| | | FAIL | FAIL | FAIL | FAIL | FAIL | | | | FAIL | FAIL |
| Mass Loss, mg | 23.0* | | | | | | 2.8 | 7.5 | 23.3 | | |

( ) = Duplicate Test;
*Average of Twenty-one tests (Range 8.7-60.8 mg)

TABLE 2

| | Mass Percent | | | | | |
|---|---|---|---|---|---|---|
| | 12 | 13 | 14 | 15 | 16 | 17 |
| OCD-289 | | 0.5 | 0.9 | 0.1 | 0.2 | 0.3 |
| Vanlube 871 | 1.0 | 0.5 | 0.1 | 0.9 | 0.8 | 0.7 |
| % Phosphorus | 0 | 0 | 0 | 0 | 0 | 0 |
| Falex Pin & Vee Block (500 lb 60 Minutes) | | | | | | |
| Duration, min. | 48 s | 60 | 60 | 25 s | 1 | 60 |
| s = seconds | | | | | | |
| | FAIL | | | FAIL | FAIL | |
| Mass Loss, mg | | 3.9 | 3.2 | | | 7.2 |

s = Seconds

Tests that ran under 60 minutes had excessive wear or high torque. Load could not be maintained.

TABLE 3

| | Mass Percent | | | | | | | | | | |
|---|---|---|---|---|---|---|---|---|---|---|---|
| | 18 | 19 | 20 | 21 | 22 | 23 | 24 | 25 | 26 | 27 | 28 |
| OCD-289 | | 0.5 | | | 0.5 | 0.9 | 0.1 | | 0.5 | | 0.5 |
| Molyvan 822 | 0.5 | 0.25 | | | | | | | | | |
| Molyvan 855 | | | 1.0 | 0.5 | 0.5 | 0.1 | 0.9 | | | | |
| Vanlube AZ | | | | | | | | 1.0 | 0.5 | | |
| Mo Naphthenate (6% Mo) | | | | | | | | | | 1.0 | 0.5 |
| % Phosphorus | 0 | 0 | 0 | 0 | 0 | 0 | 0 | 0 | 0 | 0 | 0 |
| Falex Pin & Vee Block (500 lb 60 Minutes) | | | | | | | | | | | |
| Duration, min. | 16 s | 60 | 60 | 60 | 60 | 60 | 60 | 3.5 | 60 | 5 s | 7 |
| s = seconds | | | | | | | | | | | |
| | FAIL | | | | | | | FAIL | | FAIL | FAIL |
| Mass Loss, mg | | 3.9 | 24.4 | 31.1 | 16.1 | 22.2 | 25.4 | | 12.8 | | |

TABLE 4

| | Mass Percent | | | | | | | | | |
|---|---|---|---|---|---|---|---|---|---|---|
| | 1 | 29 | 30 | 31 | 32 | 33 | 34 | 35 | 36 | 37 |
| OCD-289 | 1.0 | | 0.5 | 0.9 | 0.1 | 0.2 | | 0.5 | 0.9 | 0.1 |
| Vanlube 7723 | | 1.0 | 0.5 | 0.1 | 0.9 | 0.8 | | | | |
| Vanlube 7611M | | | | | | | 1.0 | 0.5 | 0.1 | 0.9 |
| % Phosphorus | 0 | 0 | 0 | 0 | 0 | 0 | 0.06 | 0.03 | 0.006 | 0.05 |
| Falex Pin & Vee Block (500 lb 60 Minutes) | | | | | | | | | | |
| Duration, min. | 60 | 31 | 60 | 60 | 4 | 60 | 23 | 60 | 60 | 60 |
| | | FAIL | | | FAIL | | FAIL | | | |
| Mass Loss, mg | 23.0* | | 25.0 | 17.8 | | 63.3 | | 9.6 | 13.2 | 23.3 |

*Average of Twenty-one tests (Range: 8.7-60.8 mg)

Tests that ran under 60 minutes had excessive wear or high torque, wherein load could not be maintained, are considered a FAIL.

Another embodiment of the invention relates to lubricating compositions having improved lubricating properties and comprising a major portion of an oil of lubricating viscosity and about 0.1 to about 10.0 percent by mass, based on the total mass of the lubricating composition, of a composition comprising (1) an organo borate ester composition and (2) a organic compound of the formula I, II, III, IV, V, VI, VII, or mixtures thereof. One embodiment of this lubrication composition comprises about 0.5 to about 3.0 percent by mass, based on the total mass of the lubrication composition, of a composition comprising (1) an organo borate ester composition and (2) a organic compound of the formula I, II, III, IV, V, VI, VII, or mixtures thereof.

What is claimed is:

1. A lubricating composition comprising:

(a) a major portion of an oil of lubricating viscosity; and (b) about 0.1 to 10 percent by mass of an antiwear additive comprising:

(1) an organo borate ester composition formed by reacting about 1 mole fatty oil and about 1.8 moles diethanolamine followed by subsequent reaction with boric acid, wherein the boron content of the organo borate ester composition is between 0.8 and 1.2 wt. % and, wherein the amount of organo borate ester in the lubricating composition is less than about 1.0 percent by mass; and (2) one or more components selected from the group consisting of:

(i) a 1,3,4-thiadiazole, (ii) a bisdithiocarbamate compound comprising methylene bis (dibutyldithiocarbamate),wherein the ratio of organo borate ester: bisdithiocarbamate is 1:6 to 15:1;

(iii) dithiocarbamates

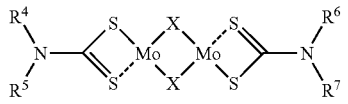

(IV)

X=S or O compound comprising molybdenum dialkyldithiocarbamate or zinc dialkyldithiocarbamate, wherein the ratio of organo borate ester: dithiocarbamate is 1:15 to 15:1

(iv)

a phosphorodithioate compound comprising primary alkyl zincdithiophosphate, wherein the ratio of organo borate ester: phosphorodithioate is 1:15 to 15:1; and (v) phosphorodithioate esters
compound comprising dialkyl dithiophosphate, wherein the ratio of organo borte ester: phosphorodithioate ester is 1:15 to 15:1; and (vi) a non-sulfur molybdenum additive prepared by reacting (a) about 1.0 mole of fatty oil having 12 or more carbon atoms, (b) about 1.0 to 2.5 moles diethanolamine and (c) a molybdenum source, wherein the ratio of organo borate ester; non sulfur molybdenum additive is 1:15 to 15:1.

2. The composition of claim 1 wherein component (2) comprises (iii) the dithiocarbamates.

3. The composition of claim 1, wherein the ratio of component (1) to component (2)is about 2:1 to 1:1.

4. The composition of claim 1, wherein component (2) comprises (ii) the bisdithiocarbamates.

5. The composition of claim 4, wherein the ratio is about 1:4 to 9:1.

6. The composition of claim 1, wherein component (2) comprises (iv) the phosphorodithioates.

7. The composition of claim 1, wherein component (2) comprises (v) phosphorodithioate esters.

8. The composition of claim 1, wherein component (2) comprises the non-sulfur molybdenum additive of (vi).

9. The composition of claim 8, wherein the ratio is about 1:1 to 3:1.

10. The composition of claim 1, wherein component (2) comprises (i) the thiadiazoles.

11. The composition of claim 10, wherein the ratio is about 3:7 to 9:1.

12. A method for providing increased antiwear protection to an engine, said method comprising the step of using a lubricating composition comprising (a) a major portion of an oil of lubricating viscosity; and (b) about 0.1 to 10 percent by mass of an antiwear additive comprising:

(1) an organo borate ester composition formed by reacting about 1 mole fatty oil and about 1.8 moles diethanolamine followed by subsequent reaction with boric acid, wherein the boron content of the organo borate ester composition is between 0.8 and 1.2 wt. % and, wherein the amount of organo borate ester in the lubricating composition is less than about 1.0 percent by mass; and (2) one or more components selected from the group consisting of:

(i) a 1,3,4-thiadiazole,
compound comprising butanedioic acid ((4,5-dihydro-5-thioxo-1,3,4-thiadiazol-2-yl)thio-bis(2-ethyl hexyl) ester,wherein the ratio of organo borate ester to the 1,3,4thiadiazole compound is 1:3 to 15:1

(ii) a bisdithiocarbamate,
compound comprising methylene bis (dibutyldithiocarbamate),wherein the ratio of organo borate ester; bisdithiocarbamate is 1:6 to 15:1;

(iii) dithiocarbamates (IV)

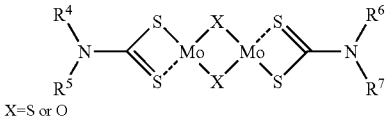

compound comprising molybdenum dialkyldithiocarbamate or zinc dialkyldithiocarbamate, wherein the ratio of organo borate ester: dithiocarbamate is 1:15 to 15:1

(iv),
a phosphorodithioate compound comprising primary alkyl zincdithiophosphate, wherein the ratio of organo borate ester: phosphorodithioate is 1:15 to 15:1; and (v) phosphorodithioate esters
compound comprising dialkyl dithiophosphate, wherein the ratio of organo borte ester: phosphorodithioate ester is 1:15 to 15:1; and (vi) a non-sulfur molybdenum additive prepared by reacting (a) about 1.0 mole of fatty oil having 12 or more carbon atoms, (b) about 1.0 to 2.5 moles diethanolamine and (c) a molybdenum source, wherein the ratio of organo borate ester: non sulfur molybdenum additive is 1:15 to 15:1.

* * * * *